United States Patent [19]

Mey et al.

[11] 4,183,594

[45] Jan. 15, 1980

[54] TWO LEVEL SEWING SYSTEM

[75] Inventors: Robert L. Mey, Jonesboro, Ark.; Roy M. Cowdrey, Greenfield, Mass.; John A. Lenhart, Bronxville, N.Y.

[73] Assignee: The Singer Company, New York, N.Y.

[21] Appl. No.: 918,119

[22] Filed: Jun. 22, 1978

[51] Int. Cl.[2] ..... A47B 51/00; D05B 75/00

[52] U.S. Cl. ..... 312/27; 312/29; 312/306; 312/312

[58] Field of Search ..... 312/27, 29, 30, 24, 312/21, 22, 208, 306, 312; 112/217.1

[56] References Cited

U.S. PATENT DOCUMENTS

| | | | |
|---|---|---|---|
| Re. 28,835 | 6/1976 | Roberts et al. | 312/29 |
| 962,700 | 6/1910 | Davis | 312/29 |
| 1,337,512 | 4/1920 | Fuelling | 312/21 |
| 2,037,479 | 4/1936 | Mossner | 312/21 |
| 2,866,677 | 12/1958 | Anderson | 312/306 |
| 3,418,031 | 12/1968 | Fisher | 312/312 |
| 3,759,595 | 9/1973 | Current | 312/27 |
| 3,788,716 | 6/1974 | Roberts et al. | 312/29 |
| 3,870,386 | 3/1975 | Shepherd | 312/30 |

FOREIGN PATENT DOCUMENTS

| | | | |
|---|---|---|---|
| 1024335 | 3/1953 | France | 312/27 |
| 498884 | 9/1954 | Italy | 312/21 |

*Primary Examiner*—Victor N. Sakran

*Attorney, Agent, or Firm*—Edward L. Bell; Robert E. Smith; Edward W. Goodman

[57] ABSTRACT

A mechanism, suitable for mounting in a sewing machine cabinet, is provided for supporting a sewing machine in a first position in which the work supporting surface of the sewing machine is coplanar with the cabinet top and a second position in which the bed of the sewing machine is elevated above the cabinet top allowing for free arm sewing. The mechanism includes a mounting cradle spaced in parallel relation above a base, which is pivotally mounted to the cabinet, and crossing brackets interconnecting the cradle and the base. A lever actuated linkage raises and lowers the cradle between the two sewing machine positions.

5 Claims, 5 Drawing Figures

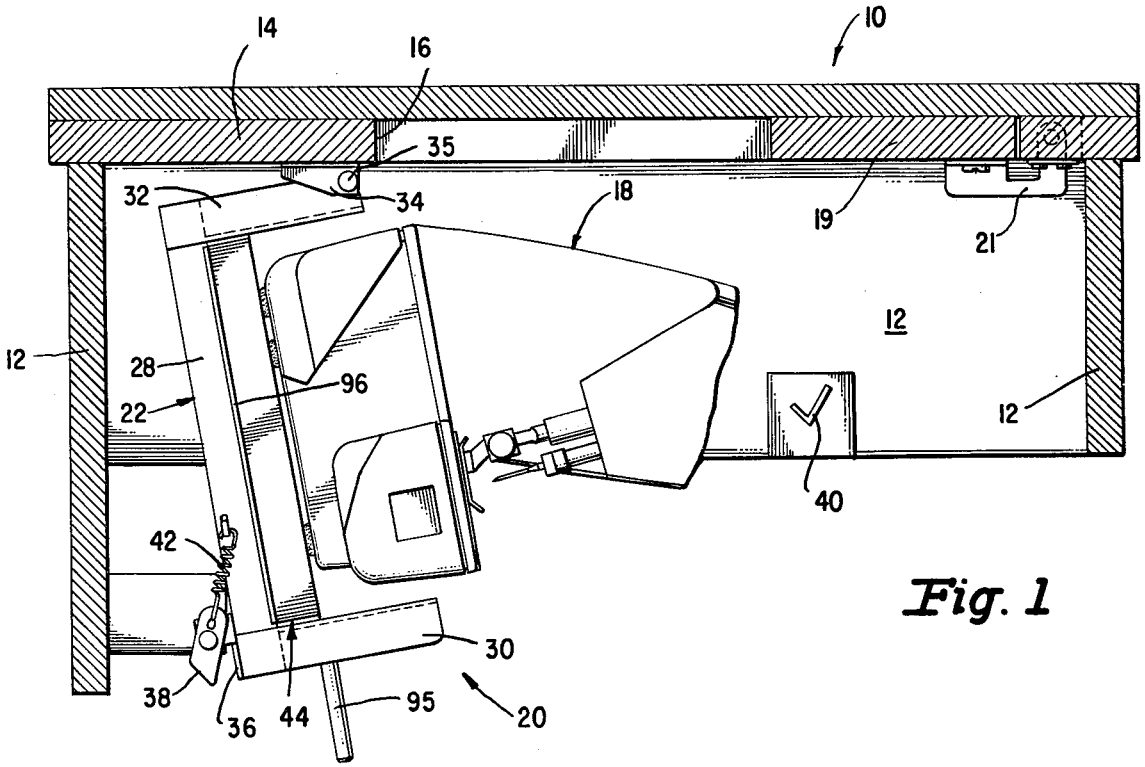
Fig. 1
Fig. 4
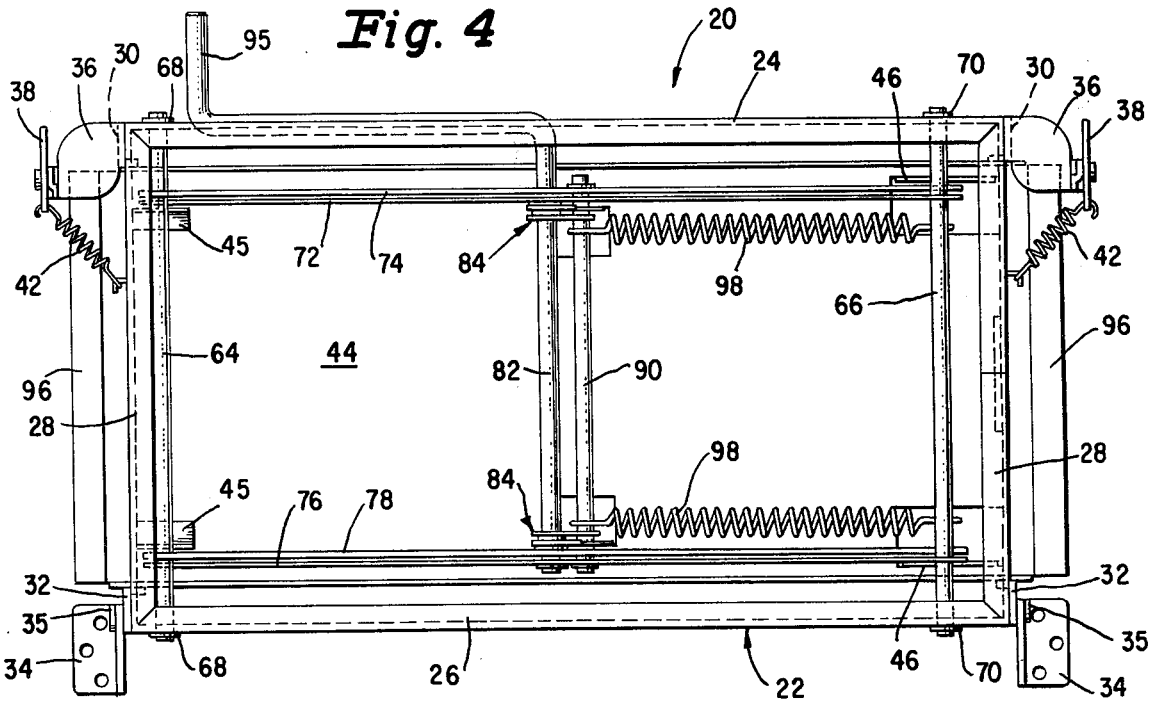

TWO LEVEL SEWING SYSTEM

BACKGROUND OF THE DISCLOSURE

This invention relates to supporting means for a sewing machine in a cabinet and, more particularly, to those supporting means capable of supporting a sewing machine in more than one position.

There are numerous devices for raising and lowering a sewing machine in a cabinet. One of these devices is disclosed in U.S. Patent No. RE.28,835 of Roberts et al includes a machine mounting platform and a base interconnected by parallel links, and a lever for raising and lowering the platform. However, when the platform is raised or lowered there is also a lateral shifting thereof requiring an oversized opening in the cabinet top.

SUMMARY OF THE INVENTION

An object of this invention is to provide a sewing machine lifting mechanism which may raise and lower a sewing machine without an accompanying lateral shifting motion.

A further object of this invention is to provide a sewing machine lifting mechanism which is readily accessible to the sewing machine operator and may be operated safely and with ease.

These objects are achieved by providing a sewing machine mounting cradle and a base interconnected by crossing brackets each of which is pivotally mounted at one end and slidably mounted at the other. A toggle linkage is incorporated between the crossing brackets and the cradle for raising and lowering the cradle and for lockably restraining the cradle in a raised position, a toggle operating arm being mounted forwardly of said mechanism and movable in an upwardly extending arc. A pivotally mounted panel is provided for easy access to the lever.

DESCRIPTION OF THE DRAWINGS

With the above and additional objects and advantages in view as will hereinafter appear, the invention will be described in reference to the drawings of the preferred embodiment in which:

FIG. 1 is a side elevational view of a sewing machine cabinet, partly in section, showing the invention supporting a sewing machine in the storage position;

FIG. 4 is a bottom plan view of the invention in the free arm position; and

DESCRIPTION OF THE PREFERRED EMBODIMENT

Figure 2:
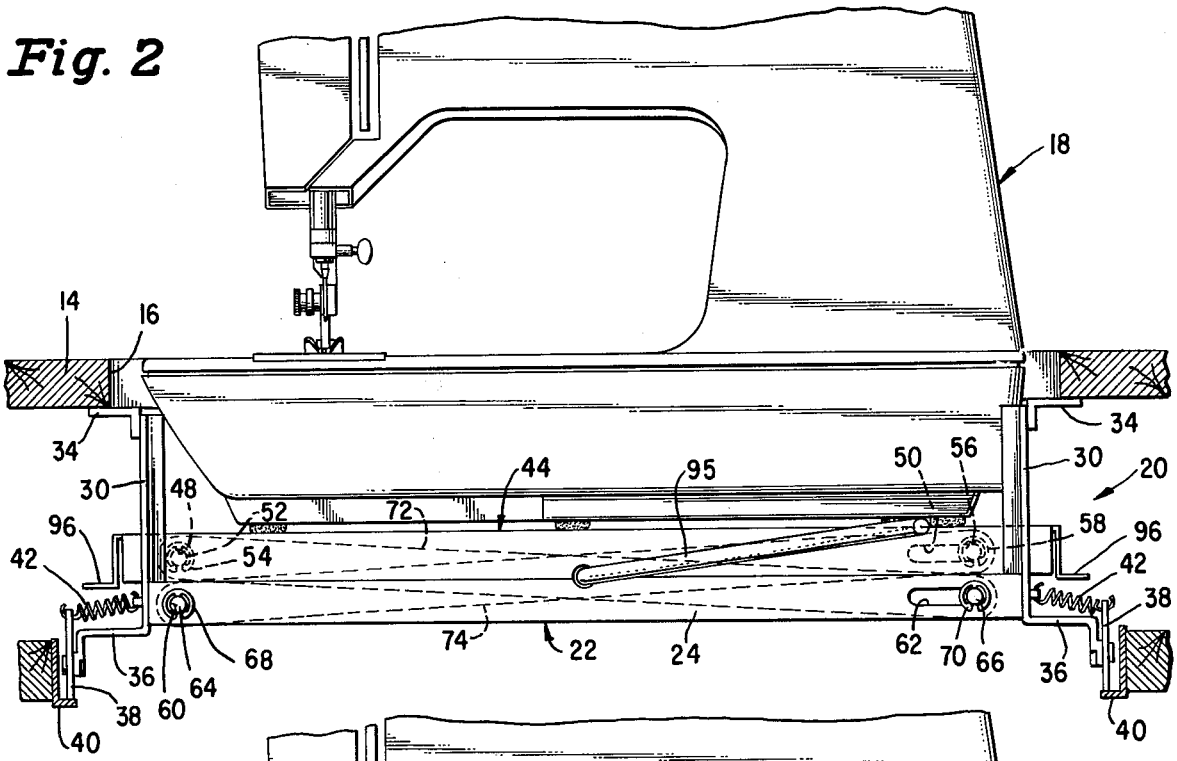
FIG. 2 is a front elevational view of the sewing machine cabinet, partly in section, showing the invention supporting a sewing machine in the flat bed mode.
Figure 3:
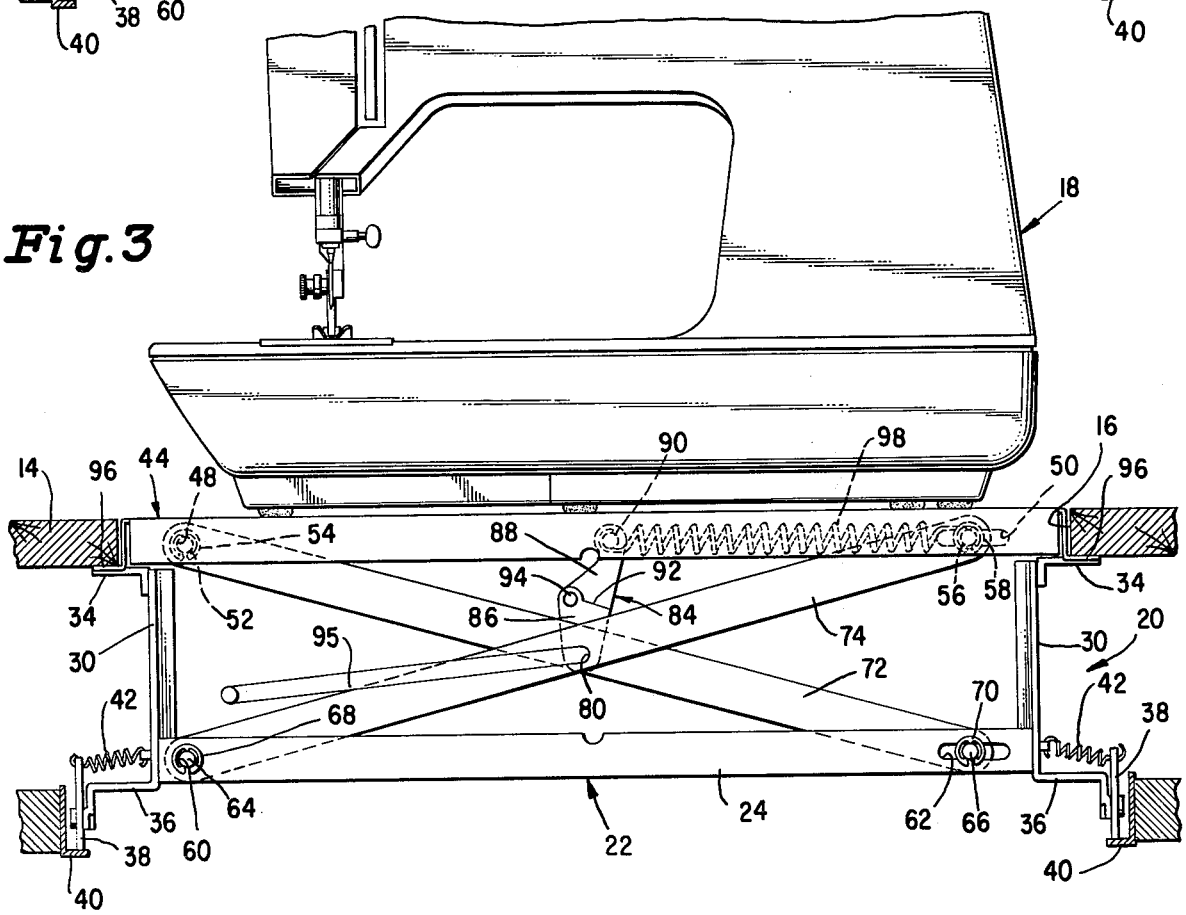
FIG. 3 is a front elevational view of the sewing machine cabinet, partly in section, showing the invention supporting a sewing machine in the free arm mode.
Figure 5:
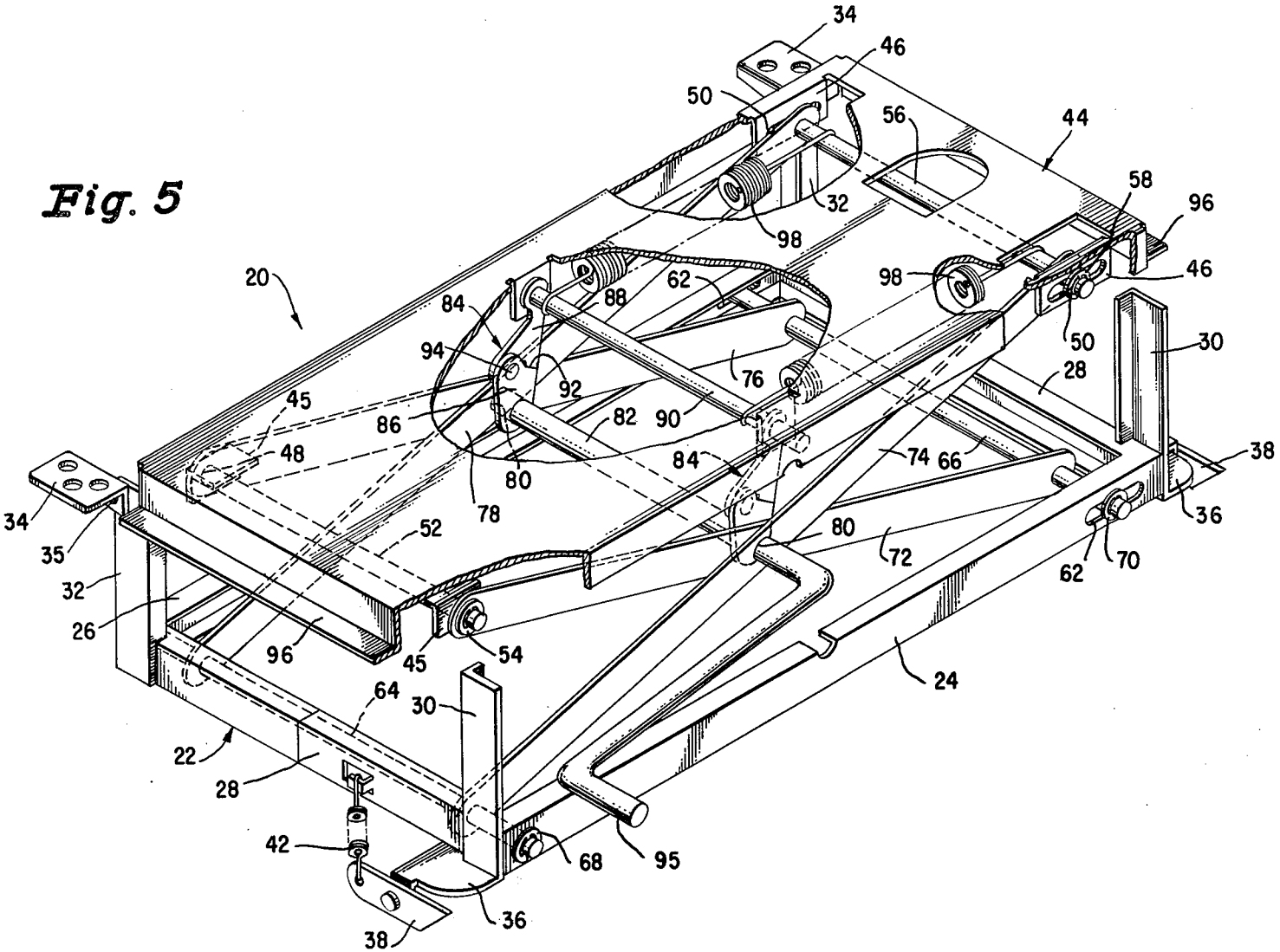
FIG. 5 is a perspective view of the invention in the free arm position.

Referring to FIG. 1, a sewing machine cabinet is generally referred to by the reference number 10. The cabinet 10 includes four sides 12 (one of which is not shown) and a substantially planar top 14. The top 14 has a centrally located opening 16 therein through which a sewing machine 18, mounted to the two level sewing system 20 of this invention, may pass. An access panel 19 is pivotally attached to the top 14 at 21 and closes a portion of opening 16.

The two level sewing system 20 includes a frame 22 having front and rear rails 24 and 26, respectively, interconnected at the ends thereof by two side rails 28. Two front and two rear upward extending limbs, 30 and 32, respectively, are affixed one at each end of the front and rear rails 24 and 26, respectively. The rear limbs 32 have mounting flanges 34 pivotally mounted as at 35 to the ends thereof which may be fastened to the underside of the top 14 rearwardly of the opening 16. Two tabs 36, extending outwardly from the ends of the front rail 24, have locking levers 38 pivotally attached thereto. The locking levers 38 selectively engage a pair of J-shaped brackets 40 mounted to the cabinet 10 for supporting the two level sewing system 20 in an operating position. Springs 42 are provided for biasing the locking levers 38 in a horizontal unlocked position. When the sewing system 20 is raised from a storage position to an operating position, the locking levers 38 are pivoted downwardly by the J-shaped brackets 40, engaging the same. By further lifting the sewing system 20, the locking levers 38, now free to rotate, return to a horizontal position, due to the action of the springs 42, allowing the sewing system 20 to be lowered back into the storage position.

A cradle 44, to which the sewing machine 18 may be mounted, is provided in parallel relation to and above the frame 22. The cradle 44 is formed with a pair of left, front and rear, tabs 45, and a pair of right, front and rear, tabs 46 depending from the bottom thereof. The tabs 45 are formed with coaxial holes 48 and the tabs 46 are formed with coaxial elongate longitudinal slots 50. A pivot rod 52 is mounted in the holes 48 spanning between the tabs 45 and is restrained from axial movement by spring clips 54. A second pivot rod 56 is slidably mounted in the slots 50 and is axially restrained by spring clips 58. The front and rear rails 24 and 26 of the frame 22 are similarly formed with corresponding holes 60 and slots 62 which accommodate pivot rods 64 and 66, respectively, axially restrained by spring clips 68 and 70, respectively.

A first pair of crossing bars 72 and 74 interconnect the pivot rods 52 to 66 and 56 to 64, respectively, at the front of the cradle 44 and the front rail 24 of the frame 22. A second pair of crossing bars 76 and 78 similarly interconnect the pivot rods 52 to 66 and 56 to 64, respectively, at the rear of the cradle 44 and the rear rail 26. The effect of the crossing bars 72 through 78 is to couple the cradle 44 with the frame 22 allowing only vertical translatory motion of the cradle 44 with respect to the frame 22.

In order to provide lifting means for raising and lowering the cradle 44, coaxial holes 80 are formed through each of the crossing bars 72 through 78 at the mid points thereof through which a shaft 82 rotatably passes. Two pairs of articulated toggle linkages 84 are provided, each having a first part 86 fixedly attached to the shaft 82, one adjacent the crossing bars 72 and 74 and the other adjacent the crossing bars 76 and 78, and a second part 88, each of which is pivotally attached to opposite ends of a pivot rod 90 mounted to the cradle 44 in parallel relation to pivot rod 52. When the shaft 82 is rotated, the toggle linkages 84 alternately raise or lower the cradle 44. The first and second parts 86 and 88 of the toggle linkages 84 are formed with surfaces 92 which engage each other when the cradle 44 is fully raised. This prevents the further rotation of the shaft 82. The pivot points 94 of each of the toggle linkages 84 is offset such that when the surfaces 92 engage, the cradle 44 will effectively be locked in position until the shaft 82 is oppositely rotated. A toggle operating arm 95 is fixedly attached to the shaft 82, in front of crossing bars 72 and 74, to facilitate the turning thereof. The orientation of the operating arm 95 is such that the movement thereof will be in an upwardly extending arc with respect to the sewing system 20. Located in this manner, the operating arm 95 may be accessed by raising the panel 19 and grasping the operating arm 95 moving it in an upward direction.

The cradle 44 is further formed with outwardly turned flanges 96 along the sides thereof for engaging the underside of the top 14 along the edge of the opening 16 when the cradle 44 is in the raised position. The flanges 96 prevent the sewing system 20 from being raised for releasing the locking levers 38, as described above, while the sewing system 20 is in the free arm mode. When the cradle 44 is being raised or lowered, the upward extending limbs, 30 and 32, prevent the cradle 44 from shifting in a forward or rearward direction. Springs 98 are attached between pivot rods 56 and 90 for urging the cradle 44 upwardly.

Numerous alterations of the structure herein disclosed will suggest themselves to those skilled in the art. However, it is to be understood that the present disclosure relate to a preferred embodiment of the invention which is for the purposes of illustration only and not to be construed as a limitation of the invention. All such modifications which do not depart from the spirit of the invention are intended to be included within the scope of the appended claims.

Having thus set forth the nature of the invention, what is herein claimed is:

1. A mechanism mountable within a sewing machine cabinet for selectively moving a sewing machine between a storage position and a first position in which the work supporting surface of the sewing machine is coplanar with the top of the cabinet and a second position in which the bed of the sewing machine is elevated above the top of the cabinet, said mechanism comprising:

a frame pivotally mounted within said cabinet for movement between said storage position and an operative position;

means for selectively securing said frame in said operative position;

a sewing machine mounting cradle;

coupling means interconnecting said cradle and said frame, and arranged to allow only translatory motion of said cradle, always parallel with respect to said frame;

lifting means including a toggle linkage means acting upon said coupling means for both raising and lowering said cradle between said first and said second positions; and means for lockably retaining said cradle in said second position.

2. A mechanism as set forth in claim 1 in which said coupling means comprise crossing bars at one end pivotally attached one to said cradle and the other to said frame, said crossing bars each being pivotally and slidably attached at the other end to said frame and said cradle.

3. A mechanism as set forth in claim 1 which further includes means for preventing said frame from being moved out of said operative position while said cradle is in said second position.

4. A mechanism as set forth in claim 1 in which said lifting means is accessible from above said cabinet.

5. A mechanism as set forth in claim 4 wherein said lifting means includes an operating arm operable in an upwardly extending arc.

* * * * *